US005702247A

United States Patent [19]

Schoof

[11] Patent Number: 5,702,247

[45] Date of Patent: Dec. 30, 1997

[54] KILN LINING AND METHOD

[75] Inventor: William H. Schoof, Peach Springs, Ariz.

[73] Assignee: Chemical Lime Company, Fort Worth, Tex.

[21] Appl. No.: 659,443

[22] Filed: Jun. 6, 1996

[51] Int. Cl.[6] ..... F27B 7/28

[52] U.S. Cl. ..... 432/103; 432/118; 432/119

[58] Field of Search ..... 432/103, 105, 432/110, 111, 118, 119

[56] References Cited

U.S. PATENT DOCUMENTS 3,445,099 5/1969 Olsen et al. ..... 263/33
3,807,936 4/1974 Vering ..... 432/103
5,040,973 8/1991 Matter et al. ..... 423/103
5,460,518 10/1995 Mosci ..... 432/103

*Primary Examiner*—Henry A. Bennett
*Assistant Examiner*—Gregory Wilson
*Attorney, Agent, or Firm*—Charles D. Gunter, Jr.; Grady K. Bergen

[57] ABSTRACT

A rotary reactor is shown having an improved internal lining including a lifter section which extends along an interior surface of the reactor chamber for lifting material from a lower portion of the chamber to an upper portion thereof as the chamber rotates. The lifter section is formed as a monolithic casting of a refractory material having a polygonal cross-section which includes a series of blunt faces alternating with a series of slanted faces. The slanted faces are aligned with a direction of rotation of the reactor such that the slanted faces of the refractory material first contact the material being lifted.

14 Claims, 2 Drawing Sheets

KILN LINING AND METHOD

BACKGROUND OF THE INVENTION

1. Field of the Invention

The present invention relates generally to rotary reactors and, more specifically, to a rotary lime kiln having an improved refractory lining.

2. Description of the Prior Art

Rotary kilns are used to produce calcined lime, Portland cement clinker, alumina, calcined products such as coke, clay, sodium silicate and other burned or calcined products. The load of raw material, for example limestone in the case of a lime kiln, is introduced at an inlet end of the kiln. The kiln is a substantially cylindrical, horizontally oriented elongate chamber having a drive means for rotating the chamber. The longitudinal axis of the rotatable chamber is given a slight slope to the horizontal so that the load within the chamber travels downwardly toward a discharge end by gravity. The load is located in a lower portion of the approximately circular cross-section of the kiln as the kiln rotates. One or more burners are located adjacent the discharge end of the rotatable chamber so that the temperature in the kiln becomes progressively hotter as the load approaches the discharge end.

All kilns are refractory lined. Most type of known refractory materials have been tried for such linings including ordinary and special fire clay brick, silica, high-alumina and basic brick. Super-duty (very dense, hard) fire clay brick is often used at the feed end of the rotary kiln because of its high abrasive resistance. Basic brick, periclase, or high alumina refractor ($Al_2O_3$) are generally used in the hottest zones of rotary kilns.

Whatever refractory is chosen, no refractory lining has been employed which endures indefinitely. Eventually attrition and spalling of the lining occurs because of abrasion, excessive temperature or sudden changes in temperature, etc. This necessitates that the kiln be periodically cooled, shutdown and repaired or realigned. If kilns are forced to produce more than their rated capacity, attrition of the linings is also heightened.

In addition, various problems occur in the operation of such kilns as the feed moves from the feed or inlet end toward the discharge end of the chamber, such as the lack of uniform heating of the bed. The lack of uniform heating can be due to insufficient agitation of the bed causing the outer layers of the material being treated to remain in the outer portion of the traveling bed, whereby some portions of the charge become over burned or over treated and other portions are under treated.

One solution to the above problems has been the use of so-called "trefoil" kilns in which the entire interior of the kiln is divided longitudinally into three or more segments by refractory block walls or by metal walls which are coated and protected with refractories. Such heat exchanger cross-section designs have been devised to augment the heat transfer of the hot exhaust gases to the kiln feed, reduce radiation losses and increase throughput. These augmentations are generally comprised of either refractory brick or special heat-resistant metal alloys and are installed as quadrants, segmenting the kiln. Generally 1 to 3 are used with the positioning being near the discharge and inlet ends of the kiln. The refractory section is used in the hotter end with the metal section being used at the relatively cooler, inlet end.

Another method for addressing the previously described problem is the incorporation of kiln internals or "lifters." Lifters are projections in the refractory lining of the kiln extending radially of the kiln in any given cross-section but generally for only a short distance as compared with the diameter of the kiln. Lifters pass beneath the bed of charge material and carry a portion of it upwardly along the side wall of the chamber before dropping it off again as it approaches the upper most point of travel in the rotation of the kiln. The particles of material being so transported fall down again into the lower portion of the chamber interior and pass through the hot furnace gases as they fall. Lifters are usually incorporated toward the hotter end of the kiln, although not usually directly in the burning or highest temperature zone of the kiln. Commonly known, conventional lifters are installed parallel to the kiln length as metal andirons with a lip that extends about 6 inches from the refractory lining and may be installed in a series for 20–60 feet or more in length.

It is accordingly an object of the present invention to provide an improved kiln lifter design which provides an improved mixing action to the load as the kiln rotates.

Another object of the invention is to provide a kiln lifter design which remains in compression during the entire rotational cycle, rather than being placed in tension, to substantially lengthen the life of the design.

Another object of the invention is to provide such a lifter design which has an improved geometry to reduce stress upon the lining allowing the use of more conventional refractory materials in the design.

Another object is to provide a lifter design which projects into the gas stream of the kiln, thereby acting as an improved heat sink, improving the overall heat transfer characteristics of the design.

Another object of the invention is to provide a lifter design which more effectively breaks up and spreads out the load of material being heated in the kiln, thereby providing an improved heat transfer.

SUMMARY OF THE INVENTION

The rotary reactor of the invention has a substantially cylindrical, horizontally oriented elongate chamber for burning materials therein. The chamber has an interior surface and a means for rotating the chamber. A plurality of lifter sections extend along the interior surface of the chamber for lifting material from a lower portion of the chamber to an upper portion thereof as the chamber rotates and for gradually dumping the material being lifted thereby from the upper portion of the chamber.

Each lifter section is formed as a monolithic casting of refractory material having a polygonal cross-section. The polygonal cross-section includes a series of blunt faces alternating with a series of slanted faces. The slanted faces are aligned with a direction of rotation of the reactor such that the slanted faces of the refractory material first contact the material being lifted. Preferably, each lifter section slanted face comprises a leading face for the lifter and each lifter section blunt face comprises a trailing face. The trailing faces of each lifter section converge at a greater angle to a radius of the interior surface of the kiln than do the leading faces, whereby the leading faces knife or slice into the load being lifted.

In the method of the invention, a rotary lime kiln is provided having a substantially cylindrical, horizontally oriented elongate chamber, the chamber having a longitudinal axis and an interior surface and having means for rotating the chamber. A refractory material is cast in the form of at least one lifting section which extends along the interior surface of the chamber. Preferably, a plurality of lifting sections extend along the interior surface at spaced intervals for lifting limestone being calcined from a lower portion of the chamber to an upper portion thereof as the chamber rotates. The refractory material is provided with a polygonal cross-section including a series of blunt faces which alternate with a series of slanted faces. The kiln is rotated in a given direction of rotation, the direction of rotation being selected such that the slanted faces of the refractory material first contact the limestone being lifted and calcined within the kiln.

Additional objects, features and advantages will be apparent in the written description which follows.

DETAILED DESCRIPTION OF THE INVENTION

Figure 1:
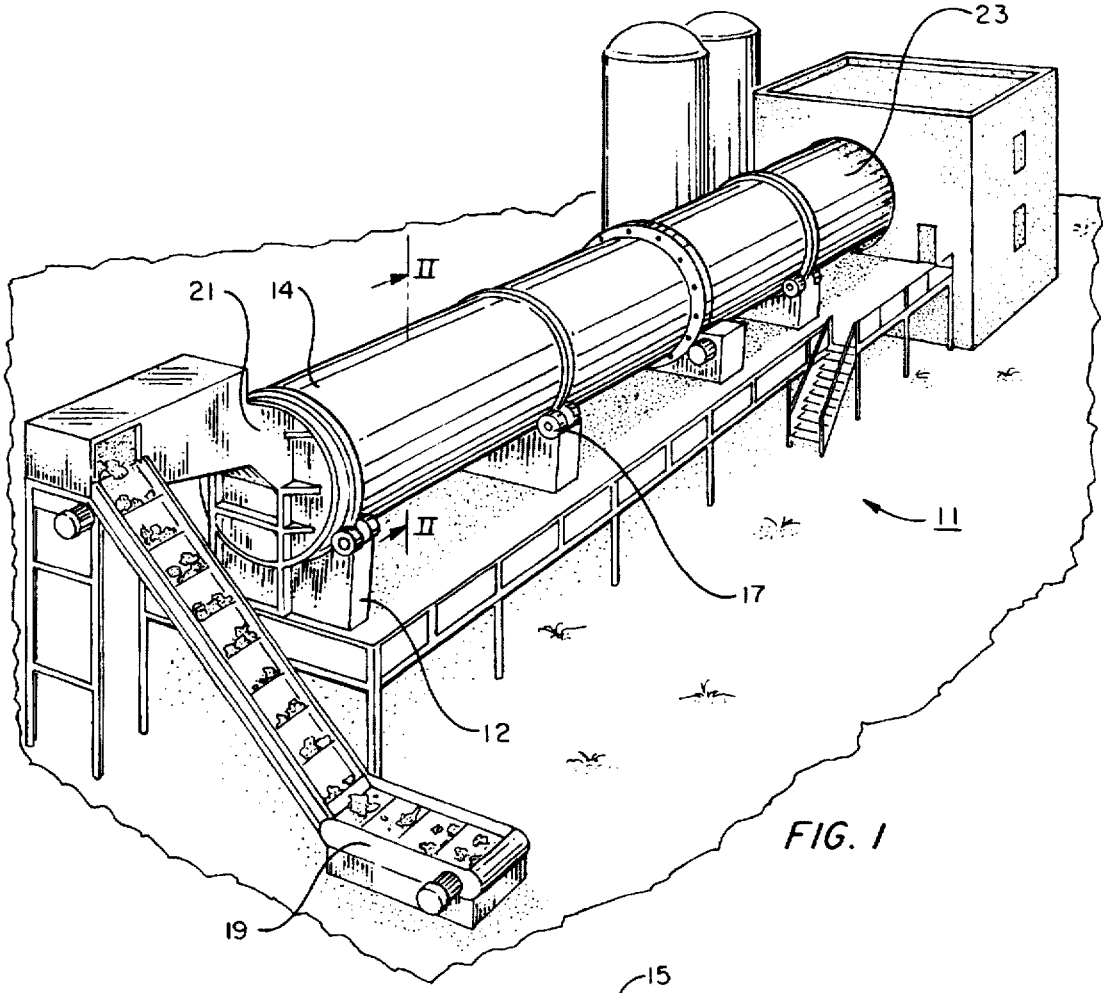
FIG. 1 is a perspective view of a rotary lime kiln showing the raw materials being introduced to the feed or inlet end of the kiln.

FIG. 1 shows a rotary reactor, in this case a rotary lime kiln, designated generally as 11. Conventional rotary kilns of the type shown typically have a diameter to length ratio of about 1:30–40 with lengths of 75–500 feet and diameters of 4–11 feet being typical. See Boynton, "Chemistry and Technology of Lime and Limestone", Wiley-Interscience, 2 Ed., pages 254–255. Such kilns are installed at an incline of 3°–5° on usually four foundation piers 12, allowing the kiln to rotate on trunnions 17 at each pier. The rotation speed of the kiln is adjustable through the use of, e.g., with variable speed drives, with the typical kiln revolving at a rate of about 35–80 revolutions per hour.

Kilns are typically lined with about 6 to 10 inches of refractory brick, plus some insulation and are encased in a shell 14 of heavy steel boiler plate that has been welded in sections. Limestone is charged into the kiln at the elevated, inlet end 21 from a storage silo or conveyor feed and quicklime is discharged at an outlet or lower end 23, moving countercurrent to the flow of combustion gases, derived from fuel injected at the lower end. Such kilns are typically charged with only a maximum of about 10% limestone so that about 90% of the interior kiln space is confined to the flame and hot gases.

Any type of fuel can be employed with rotary kilns, such as petroleum coke, coal tar from coke ovens, and waste gaseous carbon monoxide from steel and chemical plants. Pulverized coal is perhaps the leading fuel for rotary kilns in the United States. All coal burning rotary plants generally maintain their own pulverization equipment attached to each kiln. Finally divided pulverized coal of about 75% passing a number 200 mesh screen is typically used as the fuel source.

The rotary reactor 11 in FIG. 1 has a substantially cylindrical, horizontally oriented elongate chamber 13 (FIG. 2) for burning materials therein. The chamber has an interior surface and has a drive means (not shown) of conventional design for rotating the chamber on the trunnions 17. In the example shown in FIG. 1, the raw feed, in this case limestone, is fed by means of a conveyor 19 to the inlet end 21 of the rotatable chamber with product being discharged through the outlet end 23 adjacent the heat source (not shown). FIG. 3 shows a partial section of the chamber 13 which includes a metal, in this case steel outer shell 41.

Figure 2:
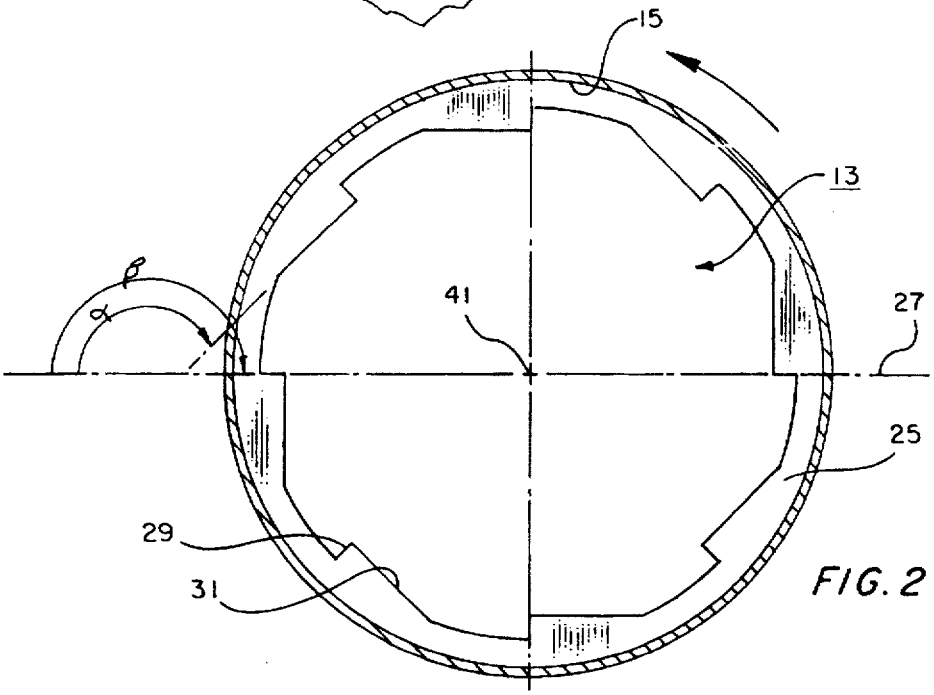
FIG. 2 is a cross-sectional view, taken along lines II—II of FIG. 1 showing one of the lifter sections thereof.
Figure 3:
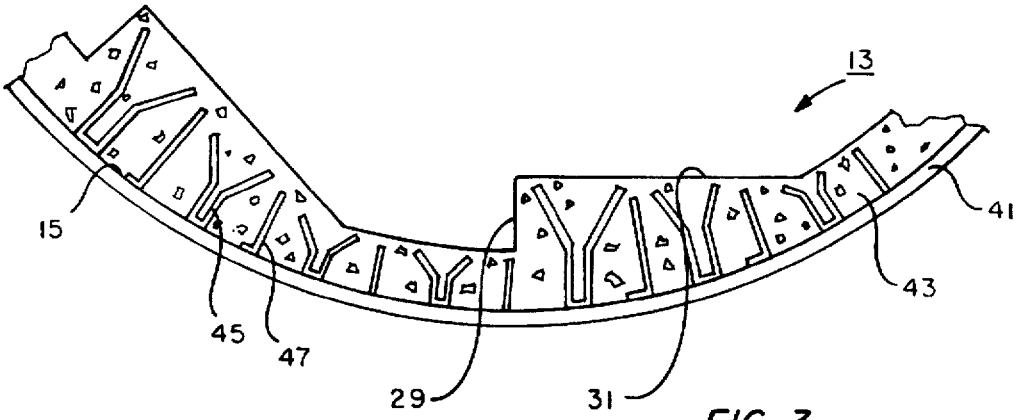
FIG. 3 is a partial, sectional view of a cast lifter section of the invention showing the anchoring elements disposed therein.
Figure 4:
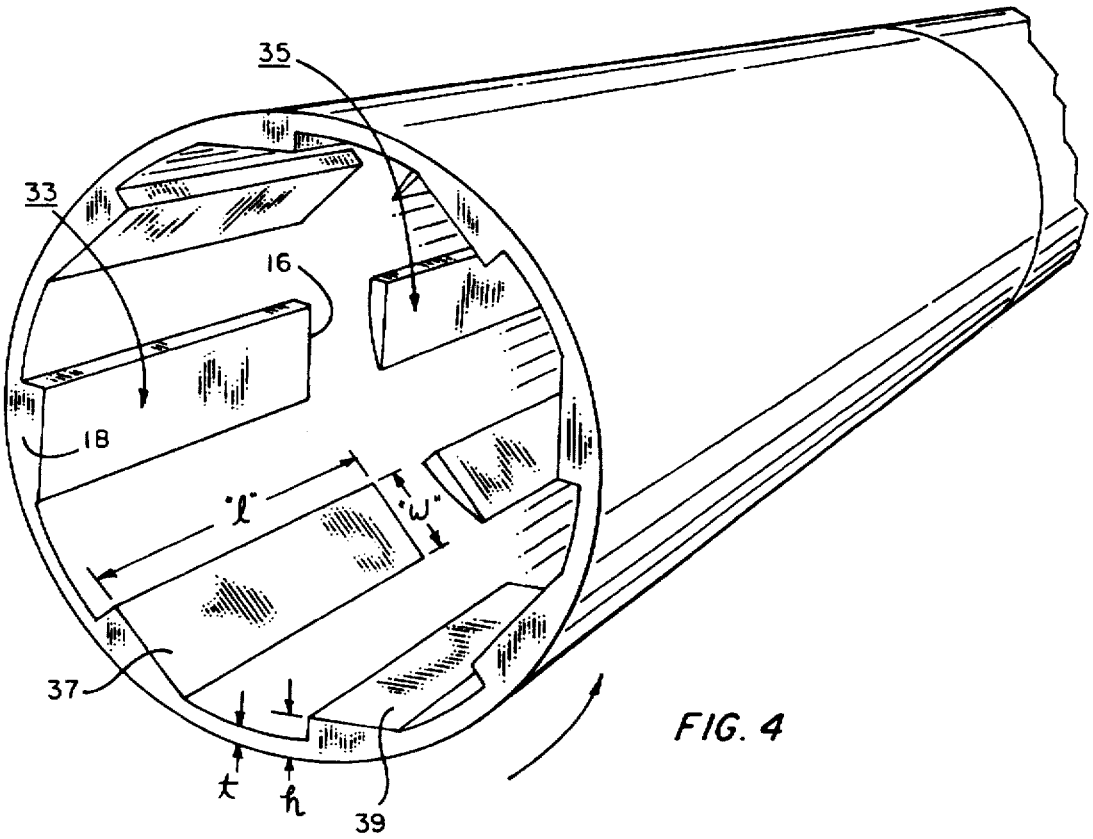
FIG. 4 is an end view of a portion of the cylindrical kiln chamber showing the spaced apart lifter sections which have been formed therein.

As shown in FIGS. 2 and 4, a plurality of lifter sections 25 extend along the interior surface 15 of the chamber 13 for lifting material from a lower portion of the chamber, generally below the centerline 27 in FIG. 2, to an upper portion above the centerline as the chamber rotates. Rotational movement of the chamber also gradually dumps the material being lifted thereby from the upper portion of the chamber as the material passes from the inlet end 21 to the discharge or outlet end 23. Each lifter section 25 is formed as a monolithic casing of a refractory material having a polygonal cross-section, as viewed in FIG. 2. By "monolithic" is meant that the lifter sections 25 are preferably cast as a single large block or piece of stone or, in this case, of refractory material. The polygonal cross-section includes a series of blunt, trailing faces 29 alternating with a series of slanted faces 31. As illustrated by the arrow in FIG. 2, the slanted faces 31 are aligned with a direction of rotation of the reactor such that the slanted faces of the refractory material first contact the limestone being lifted.

As shown in FIG. 4, each lifter section preferably forms a series of spaced lifter sets 33, 35, each lifter set being comprised of a plurality of circumferentially arranged steps 37, 39, each of which has a length "l" and a width "w." The length "l" of the steps is arranged generally parallel to the longitudinal axis of the chamber (41 in FIG. 2). Each blunt, trailing face 29 has a height "h" with respect to the thickness "t" of the shell lining. Each trailing face 29, as shown in FIG. 2, converges at a greater angle $\beta$ to a radius of the interior surface of the kiln than does the angle $\alpha$ of the leading face 31. The angle $\alpha$ in FIG. 2 is approximately 140° while the angle $\beta$ is approximately 180°. In this way, the leading faces 31 knife or slice into the load being lifted. Although the exact dimensions are not critical, the width "w" in the embodiment of the invention of FIG. 4 is approximately 3 feet, 1¼ inches. The height "h" is approximately 9 inches and the thickness "t" is approximately 9 inches. The length "l" is approximately 8 feet. The lifter elements or steps 37, 39 are symmetrically disposed, circumferentially in a ring at quadrants of the interior surface 15 of the chamber. Each lifter element 37, 39, also has an upkiln end face 16 and a downkiln end face 18.

In the method of the invention, a rotary lime kiln is provided which has an internal refractory material cast in the form of at least one lifter section which extends along the interior surface of the kiln chamber generally parallel to the longitudinal axis of the kiln. Preferably, a plurality of such lifter sections are provided for lifting limestone being calcined from a lower portion of the chamber to an upper portion thereof as the chamber rotates, gradually dumping the limestone being lifted thereby from the upper portion of the chamber. The refractory material 43 is poured in the form of a monolithic casing and is anchored within the kiln interior by means of a plurality of wire anchors 45, 47 which are welded to the chamber interior surface 15 and which extend radially outward within the refractory material 43.

The actual pouring of the refractory material is a conventional process which will be familiar to those skilled in the art and is described, for example, in issued U.S. Pat. No.

3,445,099 to Olsen et al., issued May 20, 1969, the disclosure of which is incorporated herein by reference. In casting a lining, form boards are laid entirely or as needed around an entire ring of the chamber interior. A starting form board is placed longitudinally of the kiln shell, the board being braced by andirons which are tack welded to the shell for removal after hardening of the refractory material. Metal anchors, such as the wire anchors 45, 47, are welded to the shell at suitable intervals and along with snap ties, or the like, serve to space the form boards from the shell to the desired lining depth. The anchors also serve to reinforce the cast refractory and hold it in place.

The form boards create a cavity into which refractory castable is poured to fill the space between the shell and form boards. A conventional vibrating device is then typically utilized to densify the cast refractory material. A typical refractory material is described in the Olsen reference as comprising, for example, 10 to 40% calcium aluminate cementitious agent, up to about 20% plasticizer such as pulverized clay and the remainder calcined fire clay. The dry materials are mixed with a minimum amount of water to give a casting consistency. Upon casting, the material is vibrated at high frequency, e.g., 10,000 vibrations per minute, and is allowed to harden. As shown in FIG. 3, the polygonal cross-section of the refractory material forms the series of blunt faces 29 alternating with slanted faces 31, previously described.

In use, the kiln is rotated in a given direction of rotation, illustrated by the arrow in FIG. 4. The direction of rotation is such that the slanted faces 37 of the refractory material first contact the raw material being lifted and calcined within the kiln.

An invention has been provided with several advantages. The geometry of the lifter elements provide a design for a lifter section which has no blunt leading face to impact the load as the kiln rotates. Because no bending movement is exerted on the lifter elements to put the elements in tension, the life expectancy of the lifter sections is improved, thereby eliminating down time and necessary repairs. By providing a polygonal cross-section for the lifter section which knifes into the load being processed, the lifter elements are in compression during the entire operation, thereby resulting in substantially longer life for the lifter sections and allowing the use of more conventional refractory materials. The lifter sections of the invention break up and spread out the load of material being processed more evenly within the kiln which results in improved heat transfer. The lifter sections also extend out into the gas stream of the chamber interior and act as an improved heat sink.

While the invention has been shown in only one of its forms, it is not thus limited but is susceptible to various changes and modifications without departing from the spirit thereof.

What is claimed is:

1. In a rotary reactor having a substantially cylindrical, horizontally-oriented, elongate chamber for burning materials therein, the chamber having an interior surface and having means for rotating the chamber, the improvement comprising:

a plurality of lifter sections extending along the interior surface of the chamber for lifting material from a lower portion of the chamber to an upper portion thereof as the chamber rotates and for gradually dumping the material being lifted thereby from the upper portion of the chamber, each lifter section being formed as a monolithic casting of a refractory material having a polygonal cross section including a series of blunt faces alternating with a series of slanted faces, and wherein the slanted faces are aligned with a direction of rotation of the reactor such that the lifter sections only undergo compression from the material being lifted during rotation of the chamber with the slanted faces of the refractory material first contacting the material being lifted; and wherein the means for rotating the chamber rotates the chamber in said given direction.

2. The rotary reactor of claim 1, further comprising:

anchor means for attaching the refractory material to the cylindrical walls of the chamber interior surface.

3. The rotary reactor of claim 2, wherein the refractory material forms a series of spaced lifter sets, each lifter set being comprised of a plurality of circumferentially arranged steps each of which has a length and a width, the length of the steps being generally parallel to the longitudinal axis of the reactor.

4. In a rotary kiln having a horizontally oriented, metal shell with an interior with a horizontal axis and having an exposed interior surface over which a load travels during operation of the kiln, the improvement comprising:

a plurality of lifter sections extending along the interior surface of the chamber for lifting a load from a lower portion of the chamber to an upper portion thereof as the chamber rotates and for gradually dumping the load being lifted thereby from the upper portion of the chamber, each lifter section being formed as a monolithic casting of a refractory material having a polygonal cross section including a series of blunt faces alternating with a series of slanted faces, and wherein the slanted faces are aligned with a direction of rotation of the kiln such that the slanted faces of the refractory material first contact the load being lifted; and wherein each lifter section slanted face comprises a leading face and each lifter section blunt face comprises a trailing face, the trailing faces of each lifter section converging at a greater angle to a radius of the interior surface of the kiln than the leading faces so that the leading faces slice into the load being lifted and the lifter sections only undergo compression from the load being lifted during rotation of the chamber; and further comprising means for rotating the kiln in said direction of rotation.

5. The rotary kiln of claim 4, wherein each lifter section has a plurality of lifter elements symmetrically disposed circumferentially in a ring at quadrants of the interior surface of the chamber.

6. The rotary kiln of claim 5, wherein each lifter element extends above the exposed interior surface of the chamber in a direction generally parallel to the longitudinal axis of the kiln, whereby each lifter element engages and lifts a portion of the load upwardly along an arc of the chamber interior.

7. The rotary kiln of claim 6, wherein each lifter element, in addition to a leading face and a trailing face, has an upkiln end face and a downkiln end face and wherein each lifter section has embedded and enclosed therein an anchor means for attaching the lifter elements to the metal shell.

8. The rotary kiln of claim 7, wherein the anchor means for attaching the lifter sections to the interior surface of the chamber of the kiln comprises a plurality of wire anchors which are welded to the interior of the metal shell and which extend outwardly into the chamber interior within the refractory material.

9. In a rotary lime kiln having a substantially cylindrical, horizontally-oriented, elongate chamber for calcining limestone therein, the chamber having a longitudinal axis and an interior surface and having means for rotating the chamber, the improvement comprising:

a plurality of lifter sections extending along the interior surface of the chamber for lifting limestone from a lower portion of the chamber to an upper portion thereof as the chamber rotates and for gradually dumping the limestone being lifted thereby from the upper portion of the chamber, each lifter section being formed as a monolithic casting of a refractory material having a polygonal cross section including a series of blunt faces alternating with a series of slanted faces, and wherein the slanted faces are aligned with a direction of rotation of the kiln such that the lifter sections only undergo compression from the limestone being lifted during rotation of the chamber with the slanted faces of the refractory material first contacting the limestone being lifted; and wherein the means for rotating the chamber rotates the chamber in said given direction of rotation.

10. A method of calcining limestone within a rotary lime kiln having a substantially cylindrical, horizontally-oriented, elongate chamber, the chamber having a longitudinal axis and an interior surface and having means for rotating the chamber, the method comprising the steps of:

casting a refractory material in the form of at least one lifting section which extends along the interior surface of the chamber for lifting limestone being calcined from a lower portion of the chamber to an upper portion thereof as the chamber rotates, gradually dumping the limestone being lifted thereby from the upper portion of the chamber;

providing the refractory material with a polygonal cross section including a series of blunt faces alternating with a series of slanted faces, the slanted faces being oriented at a selected angle to a radius of the interior surface; and rotating the kiln in a given direction of rotation, the direction of rotation being such that the slanted faces of the refractory material first contact the limestone being lifted and calcined within the kiln, and wherein the selected angle is such that the at least one lifting section only undergoes compression during rotation of the kiln.

11. The method of claim 10, wherein the refractory material which is provided within the kiln interior is provided in the form of a monolithic casting.

12. The method of claim 11, wherein each lifter section has a plurality of lifter elements symmetrically disposed circumferentially in a ring at quadrants of the interior surface of the chamber.

13. The method of claim 12, wherein each lifter section slanted face comprises a leading face and each lifter section blunt face comprises a trailing face, the trailing faces of each lifter section converging at a greater angle to the radius of the interior surface of the kiln than the leading faces, whereby the leading faces slice into the limestone being lifted.

14. The method of claim 13, wherein the refractory material is anchored within the kiln interior by means of a plurality of wire anchors which are welded to the interior of the kiln chamber and which extend outwardly into the chamber interior within the cast refractory material.

* * * * *